United States Patent [19]

Mantovani

[11] Patent Number: 4,867,814

[45] Date of Patent: Sep. 19, 1989

[54] PROCESS AND EQUIPMENT FOR MAKING CAPILLARY YARN FROM TEXTILE YARNS

[75] Inventor: Elis Mantovani, Cadempino, Switzerland

[73] Assignee: Tecnodelta S.A., Bioggio, Switzerland

[21] Appl. No.: 140,247

[22] Filed: Dec. 31, 1987

[30] Foreign Application Priority Data

Dec. 18, 1987 [CH] Switzerland ..... 4946/87

[51] Int. Cl.[4] ..... B43K 1/12

[52] U.S. Cl. ..... 156/64; 57/7; 156/154; 156/180; 156/378

[58] Field of Search ..... 156/180, 154, 64, 328; 57/7, 11, 12; 401/198, 199

[56] References Cited

U.S. PATENT DOCUMENTS

| | | | |
|---|---|---|---|
| 3,558,392 | 1/1971 | Goodenow et al. | 156/180 |
| 3,945,869 | 3/1976 | Miller | 156/441 X |
| 4,095,404 | 1/1978 | Babayan | 57/297 |

*Primary Examiner*—David Simmons

*Attorney, Agent, or Firm*—Young & Thompson

[57] ABSTRACT

The process comprises the sequence of the following operations:

(a) joining (3) of different elementary staples, each formed by a group of continuous or staple fibers to form a single staple;

(b) possible twisting in one direction or the other with different angle of twist of said single twisted staple;

(c) setting of the degree of moisture of said single staple (5) at the preestablished value;

(d) resining of said moistened twisted single staple (6) with penetration of the resin to the value preselected for final use;

(e) polymerization of said resined staple (7) with supply of heat to the values preset as a function of final use;

(f) cooling of yarn (8) to store the condition of straightness in the capillary yarn thus obtained;

(g) rewinding of the polymerized and cooled yarn (9) on a reel with orderly turns;

(h) finishing of the outside surface of the yarn (FIG. 2) by removal of material, defining geometric shape and dimensions with high precision;

(i) cutting of the finished yarn (FIG. 3) into sticks of various lengths and with variously shaped ends depending on the final use;

(k) a control and inspection procedure.

14 Claims, 5 Drawing Sheets

PROCESS AND EQUIPMENT FOR MAKING CAPILLARY YARN FROM TEXTILE YARNS

Automatic processes are known for making capillary fibers from textile yarn to be used especially for making felt tip pens. Said equipment generally consists of a device suitable for combing the yarn, a second device suitable for twisting, a third device suitable for resining and polymerization, a fourth device suitable for milling the outside diameter of the yarn and a fifth device suitable for making the finished piece.

Therefore to produce a capillary yarn from textile yarn, three individual specific units, which cannot be connected together, are necessary and obviously require storage of the preworked material. Therefore the operation of said equipment is relatively inflexible, i.e., does it not allow reliable control of the characteristics of the yarn, i.e., speed of transport of a liquid as a function of viscosity, mechanical strength of the yarn, compactness, sharpness of the line obtainable in case of application to felt tip pens, uniformity of the thickness and intensity of the color during writing. Production of capillary yarn as a result of the operation of said equipment, because of the various steps, therefore provides great technical and managerial difficulties. Particular technical difficulties are encountered especially in the variability of the angle of twist, therefore in the compactness and variation of the degree of moisture. The managerial difficulties result from the necessity of having to predetermine the characteristics of combing, twisting and concentration of yarn precisely because of the requirement for speed. Besides all this, there is still the fact that said equipment cannot easily be transformed for the production of capillary yarn with round section or polygonal section.

There are also other disadvantages with regard to wasting energy, the difficulties of installation and maintenance, since generally vertical ovens are used for polymerization of the capillary yarn, after resining; these ovens require a very high room and hence the waste of energy of the equipment itself, for air conditioning of the room, because of difficulties of installation and maintenance.

The object of the invention is to provide a high-productivity process, which can be operated electronically, as described in the claims.

The object of the invention is a device for practicing the process characterized in that, according to the claims phase (k), the control and inspection procedure—at different stages of the process to define possible dynamic corrections of the parameters which determine the functional characteristics, i.e.: compactness, elasticity, hardness, rate of absorption, capacity—is performed by means of specific semiautomatic devices making possible the reliable control of the characteristics of the yarn and of the finished pieces as a function of the final result it is desired to obtain.

The advantages of the device in question with respect to the known art are the following: perfect control of the functional characteristics of the capillary yarn—speed of transport of a liquid as a function of viscosity, mechanical strength, degree of compactness, sharpness of the line obtainable in case of application to felt tip pens, uniformity of the thickness and intensity of the color during writing—; easy installation; saving of energy; versatility of the equipment and easy maintenance.

The accompanying drawings represent a preferred nonlimiting, nonbinding embodiment of the equipment for performing the process according to the invention.

FIG. 1 depicts the unit for producing capillary yarn from textile yarn plus resin;

FIG. 1*a* depicts the reel on which the resined, polymerized and cooled yarn is wound;

FIG. 2 depicts the unit for performing rough and finish grinding of the outside surface of the yarn;

FIG. 2*a* depicts the unit for performing rough and finish grinding of the outside surface of the yarn;

FIG. 3 depicts the unit for performing the grinding of both parts of the finished yarn from the preworked yarn;

FIG. 3*a* depicts the unit for performing the grinding of both parts of the finished yarn from the preworked yarn;

FIG. 4 partially depicts the unit illustrated in FIG. 1;

Figure 1:
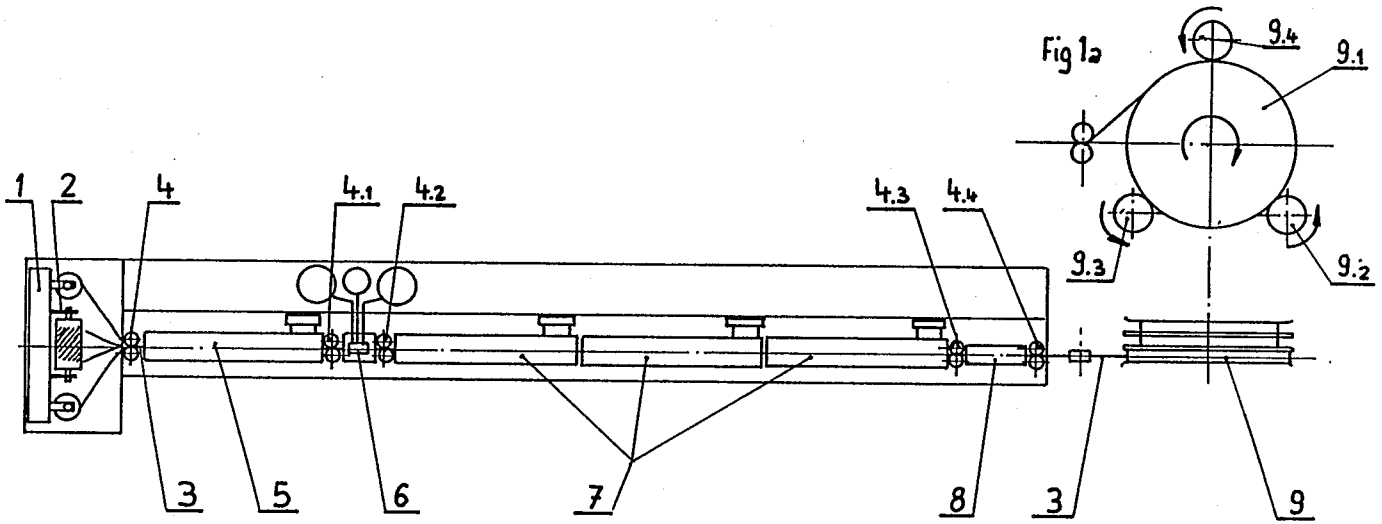
Figure 3:
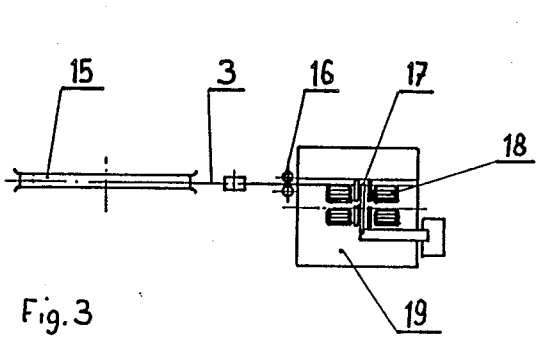
Figure 14:
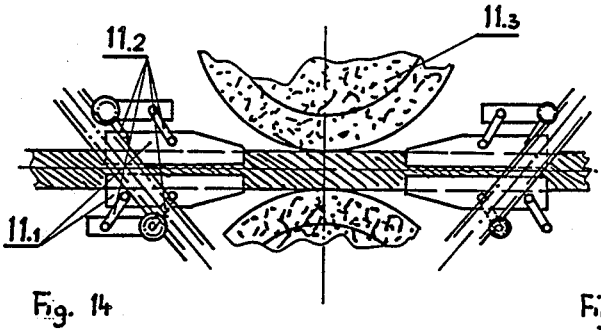
Figure 15:
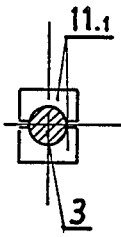
Figure 16:
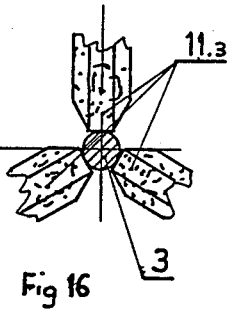
Figure 17:
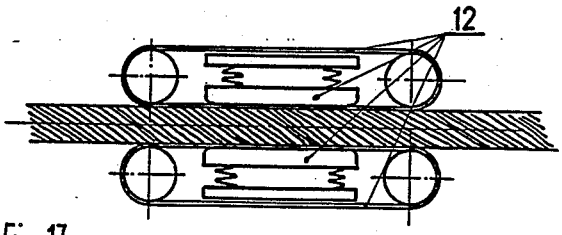
Figure 18:
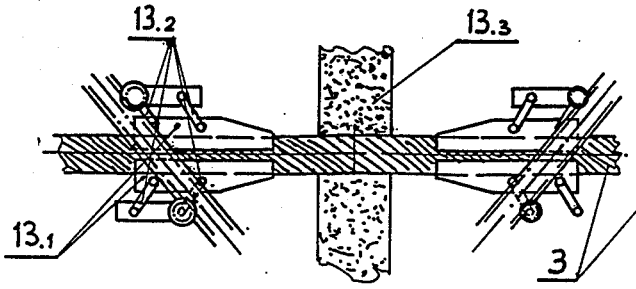
Figure 19:
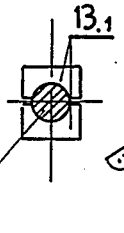
Figure 20:
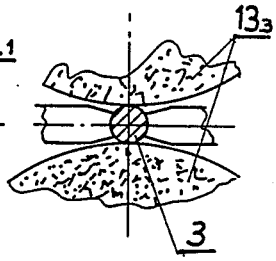
Figure 3A:
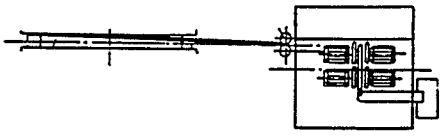
Figure 21:
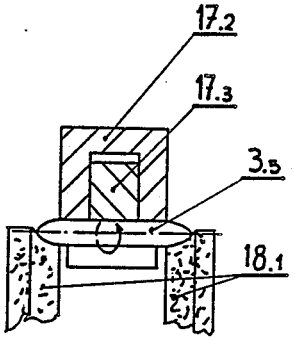
Figure 22:
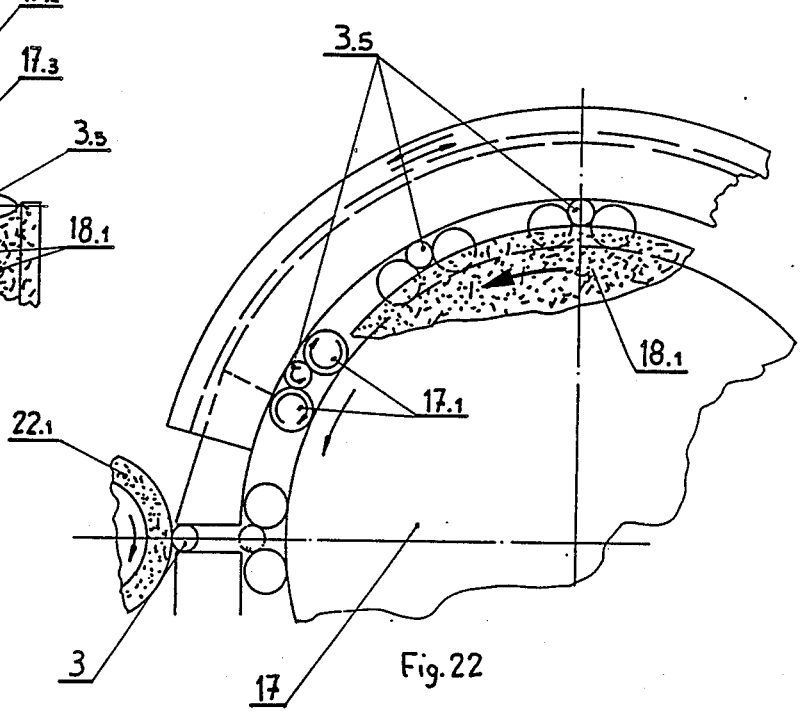
Figure 4:
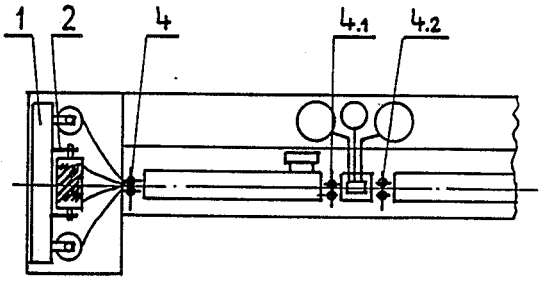
Figure 8A:
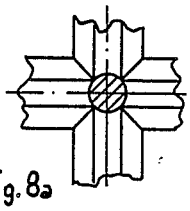
Figure 8B:
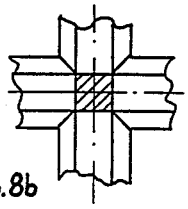
Figure 8C:
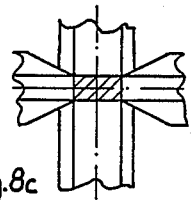
Figure 8D:
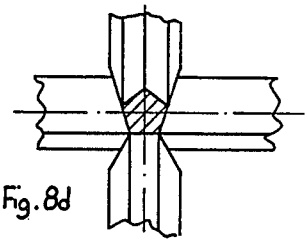
Figure 8E:
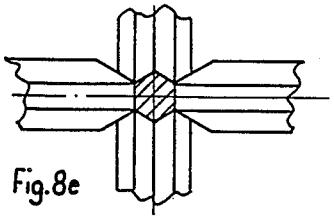
Figure 9:
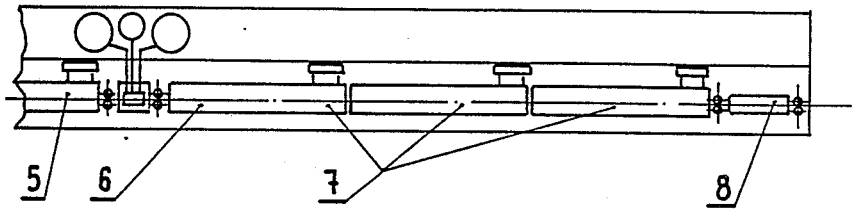
Figure 10:
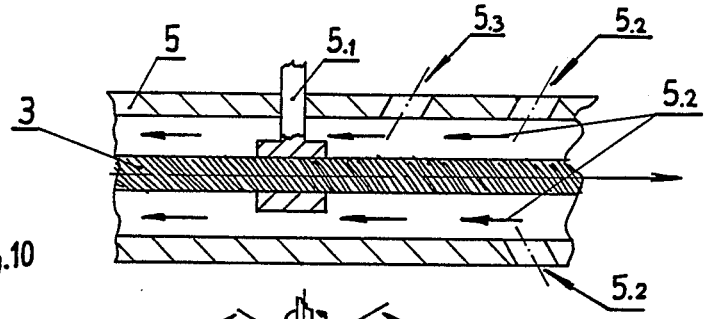
Figure 11:
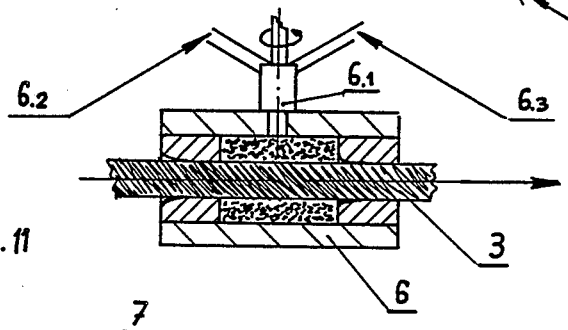
Figure 12:
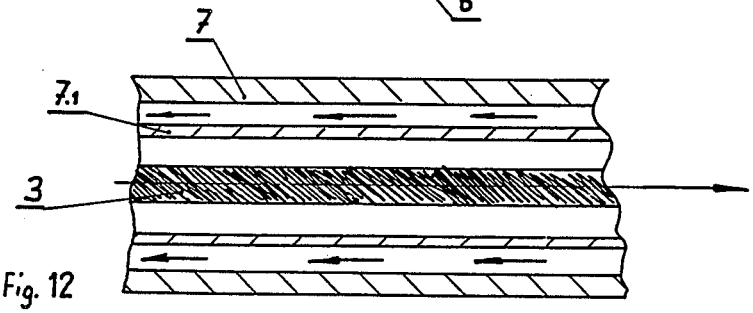
Figure 13:
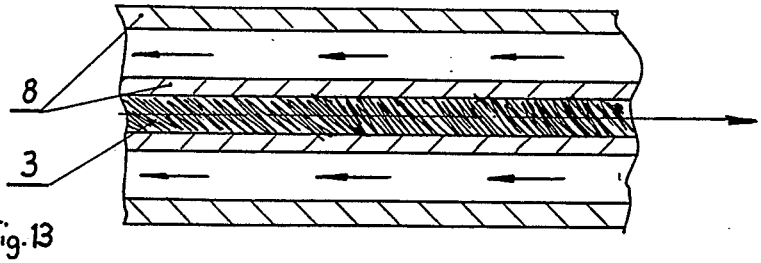

FIG. 8*a* depicts the detail relative to the feed rolls shaped for yarn with round section;

FIG. 8*b* depicts the detail relative to the feed rolls shaped for yarn with square section;

FIG. 8*c* depicts the detail relative to the feed rolls shaped for yarn with rectangular section;

FIG. 8*d* depicts the detail relative to the feed rolls shaped for yarn with pentagonal section;

FIG. 8*e* depicts the detail relative to the feed rolls shaped for yarn with hexagonal section;

FIG. 9 partially depicts the unit illustrated in FIG. 1;

FIG. 10 depicts the detail relative to setting the degree of moisture;

FIG. 11 depicts the detail relative to resining of the single moistened twisted staple;

FIG. 12 depicts the detail relative to polymerization of resined staple;

FIG. 13 depicts the detail relative to cooling the yarn;

FIG. 14 depicts the detail relative to rough grinding of the outside surface of the yarn;

FIG. 15 depicts the detail relative to FIG. 14;

FIG. 16 depicts the detail relative to FIG. 14;

FIG. 17 depicts feeding of the yarn by the unit for performing roughing and finishing of the outside surface of the yarn;

FIG. 18 depicts the detail relative to finish grinding of the outside surface of the yarn;

FIG. 19 depicts the detail relative to FIG. 18;

FIG. 20 depicts the detail relative to FIG. 18;

FIG. 21 depicts the detail relative to grinding of both parts of finished piece;

FIG. 22 depicts the detail relative to the unit represented in FIG. 3*a*.

Said equipment consists of a series of automatic devices, which can be operated electronically, with high productivity, suitable for the production, even in small series, of parts able to transport liquids by capillary action. The most important application is for making writing points: pens, felt tip pens and highlighters. The raw materials necessary for practice of the process are: textile yarn with continuous or staple fibers—nylon, polyester, etc—and resin—epoxide or polyurethane, etc.—with two components.

In regard to the writing points, the particular characteristics that are obtainable are: smooth-flowing writing at any angle of incidence, constant and sharp line, use of any liquid ink with water, alcohol, etc., independence from the material of the ferrule—metal or plastic.

The construction of the equipment, while being designed for high, continuous production (24 hours a day), permits great flexibility. In a very short time, by substituting a few parts, it is possible to change the dimensions or shape of the product.

Figure 2:
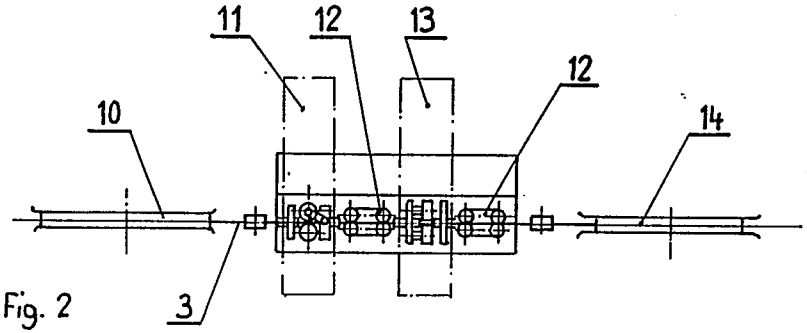
Figure 2A:
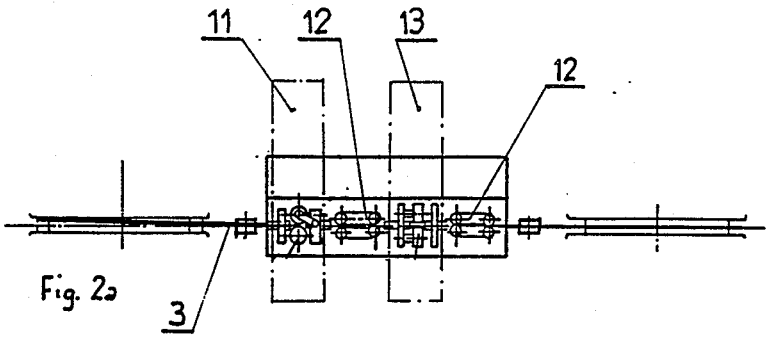

The equipment comprises the following:

a unit for producing capillary yarn (FIG. 1) starting from textile yarn plus resin;

a unit for performing the roughing and finishing of the outside surface of the yarn (FIG. 2).

a unit for performing the grinding of both parts (FIG. 3) of the finished yarn, starting from the preworked yarn.

Figure 5:
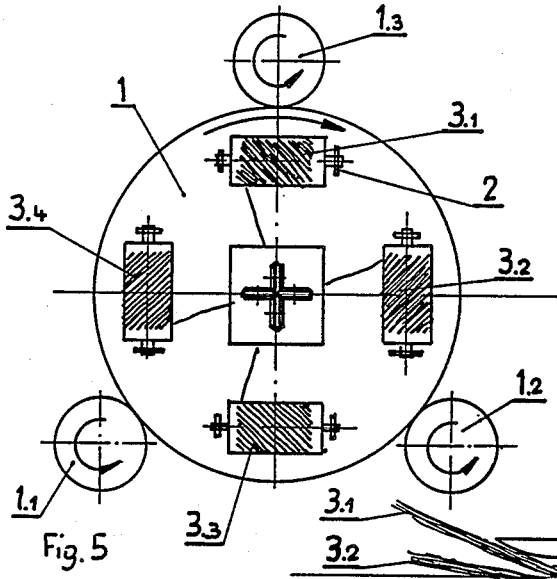
FIG. 5 depicts the detail relative to the joining of elementary staples into a single, twisted staple.
Figure 6:
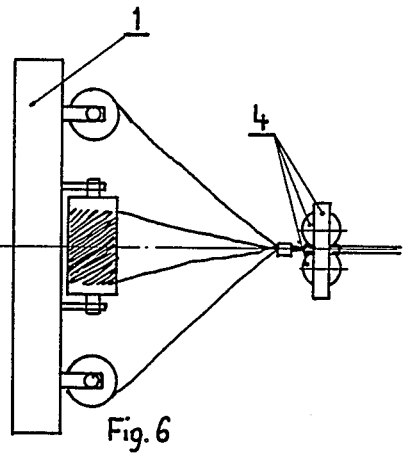
FIG. 6 depicts the detail of FIG. 5 seen from another angle.
Figure 7:
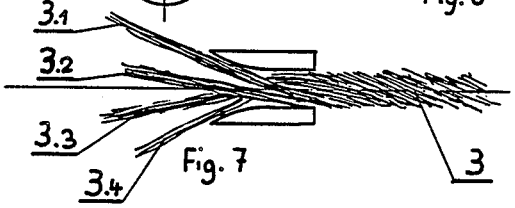
FIG. 7 depicts the joining of elementary staples into a single staple and twisting of the staples.

FIG. 1 represents the automatic unit, with continuous transfer, suitable for production of capillary yarn (3, FIG. 7) from textile yarn and two-component resin. The feed group (1, FIG. 1, FIG. 4, FIG. 5, FIG. 6) is supplied with hanks of textile yarn—normally from 1 to 24 bobbins—or provides for feeding the unit. The elementary staples ($3_1$, $3_2$, $3_3$, $3_4$, FIG. 5) are conveyed and therefore united in the first group of feed rolls (4, FIG. 1); thus the desired angle of twist is also determined, since the bobbins in the feeder orbit around the axis of the yarn being formed at a certain number of rotations, which is variable, relative to the feeding. The just formed yarn goes into the moisture control group (5, FIG. 1, FIG. 10); it will come out with a determined and constant degree of moisture. A second group of feed rolls ($4_1$, FIG. 1) determines the tension of the yarn in the moisture control group, while a third group ($4_2$, FIG. 1), placed at the outlet of the resining unit (6, FIG. 1, FIG. 11) defines the tension of the yarn during this last operation. The regular supply of resin ($6_2$, $6_3$, FIG. 11) is assured by a suitable device ($6_1$, FIG. 11) which also provides the metering and continuous mixing of the two components ($6_2$, $6_3$, FIG. 11). The suitably resined yarn continues through the oven ($7_1$, $7_2$, $7_3$, FIGS. 12 and 13); the heat, which accumulates in the yarn, favors and accelerates the polymerization process. The necessary tension of the yarn, during this last process, is determined by the fourth group of feed rolls ($4_3$, FIG. 1). The yarn, now finished and capillary, goes into the cooling group (8, FIG. 1 and FIG. 13) pulled by the fifth group of feed rolls ($4_4$, FIG. 1).

The construction of the equipment—to guarantee the fundamental operating characteristics of reliability and high productivity—is made according to the criteria of modularity. Each specific module performs a specific operation. Said modules are interchangeable among themselves, achieving notably versatility of the equipment.

The feeding device is located in a unitized steel structure in which are placed the main variable speed gear—which drives the entire unit, the mechanisms for driving the feeder and the feeder itself. The latter element (1, FIG. 1, FIG. 5, FIG. 6)—large drum wheel in which are loaded normally up to 24 bobbins of yarn ($3_1$, $3_2$, $3_3$, $3_4$, FIG. 5)—is held and centered by 3 pairs of rolls ($1_1$, $1_2$, $1_3$, FIG. 5). One of the 3 pairs of rolls is driving and provides the drive in rotation of the feeder in variable synchronization with the yarn feeders (4, $4_1$, $4_2$, $4_3$, $4_4$, FIG. 1). The movement reaches said pair of rolls from the main variable speed gear by means of a differential transmission that makes it possible to modify the transmission ratio between the feeder and yarn feed rolls, therefore allowing a broad variation of the angle of twist—from zero turns per meter to 50 turns per meter of right and left twist. The feeder drum is supplied with yarns in bobbins and prepared outside the unit; with the help of special equipment, after loading of the bobbins, joining is performed by gluing the individual yarns to a specific piece of yarn already resined and polymerized.

Said arrangements thus make possible the rapid replacement of the feeder used up by now, and an equally rapid restart of production. The unit is completed with the necessary electrical monitoring controls and the relative electronic control equipment.

The devices that provide the feeding of the yarn—normally 5 (4, $4_1$, $4_2$, $4_3$, $4_4$, FIG. 1)—are provided for each of them with 4 pulling rolls placed opposite one another and suitably shaped (FIG. 8*a*, FIG. 8*b*, FIG. 8*c*, FIG. 8*d*, FIG. 8*e*) so that, at the contact point, a clearance is formed having the same shape as the yarn to be produced should have. The mounting of said rolls on their support is such as to allow rapid replacement in case of wear, or in case the dimension—or shape—of the yarn to be produced has to be changed. The shaped track of each individual roll is made on a ring of easily workable synthetic material mounted on two half-wheels completed by bearings and transmission gears. The drive of said rolls is provided in two versions: one with a fixed torque and one provided instead with an adjustable torque. The two types are connected, by means of an inextensible cogged belt, to a worm reduction gear, connected in turn, by means of special shaft, to main variable speed gear located in the feed group. The adjustable torque differs from that of the fixed torque, in that it has a reduction gear/variator which, while receiving the movement from the same main variable speed gear, makes it possible to vary the total transmission ratio, allowing the compensation of the gradual variations of the length of the yarn during the process. Adjustment of the torque is possible since said feed rolls are provided with a clutch with adjustable spring means by which, by acting on the latter, pulling with the desired torque value is obtained. The complete units are mounted on different modules depending on the specific requirements of the product and can be replaced or exchanged to the extent they are interchangeable. Dismounting and the relative remounting of the shafts can take place easily and quickly without having to intervene on the reducing gears, so as to simplify maintenance to the maximum.

The resining device (6, FIG. 1 and FIG. 11) is an automatic mechanical group completed by all the elements suitable for preparation of the two-component resin and for the uniform, continuous resining of the yarn. The yarn guided and kept under constant tension by the feed rolls ($4_1$, $4_2$, FIG. 1), goes through the device receiving a determined constant supply of resin. Two bushings—of section according to the shape of the yarn—guide and shape the yarn at the inlet and outlet of the device. The resining takes place between said bushings; a special rotating screw mixer, of small dimensions ($6_1$, FIG. 11), maintains the resin flow at constant viscosity and pressure. To maintain such parameters constant, the device is provided with an electric heating system which keeps the temperature constant at a predetermined value and with a pressure control system which means for increasing or decreasing the rotating speed of the mixer; in this way there is guaranteed a constant supply of resin on the yarn at a preset value. A metering device, with mechanical proportioning, determines the flow of the two components ($6_2$, $6_3$, FIG. 11) which flow, introduced by the metering device itself, from the respective containers located on the back side of the device. The device has a base, of unitized steel sheet that mounts the various operating elements and, fastened to its back side, a system for sections supports a box which acts as a container of the electric devices, as a cowling with upper fastener and as a support for lateral longitudinal fasteners. Close to the two head sides of the base are seats on which are mounted the feed rolls complete with transmission and drive shafts. The module is completed by its electric equipment: located in the upper box, already mentioned, it assures the control and monitoring of the specific operations of the device; coordination of the automatic operations and therefore the interdependence of the various devices is entrusted to the electronic control group of the unit.

The moisture control devices (5, FIG. 1) and polymerization oven (7, FIG. 1) are identical in design; substantially comprising hot air ovens. The different operations—moisture control and polymerization oven—are achieved by suitably modifying the temperature and amount of hot air. The units, normally 4, are comprised of:

A base of unitized steel sheet resting on the floor by means of four antivibrating supports and provided with mechanical and electrical connections for connecting to any other module. On the upper part, along the longitudinal axis is mounted the hot air oven completed by electromechanical devices for closing and opening of the ovens during the phase of starting or ending production.

On the longitudinal side, considered the back side, is mounted the low-pressure centrifugal fan which brings the necessary hot air into the ovens. Close to the two head sides are seats on which are optionally mounted the yarn feed rolls depending on the position occupied by the module in the specific composition of the unit. Completing the structure, a system of sections, fastened to the back side, support a box, along the base, which acts as a container for the electrical equipment, as a cowling and as a support for the lateral longitudinal fasteners.

A hot air oven which is a tubular tunnel round in shape and comprised of two halves, the yarn, guided and kept under constant tension by the feed rolls, passes along the center of the system and, without touching the walls, is heated to the temperature required by the operation. The construction, in section, exhibits three tubular elements: the first ($7_1$, FIG. 12), at the center of the system, is the element in which the yarn travels; it is formed by two aluminum half-tubes fastened, so as to be easy to replace, to the respective half-tunnels. Two probes, inserted in one of the half-tunnels, continuously report the actual temperature of the heating half-tubes and provide, by a suitable electronic system, maintenance of the desired temperature. The second element (7, FIG. 12), concentric with and outside the first, is the conveyor within which passes the hot air which furnishes heat to the heating half-tubes. Also this element is formed by steel half-tubes fastened to the respective parts of the third element. One of the terminals, in volute form, acts as a diffuser and support of the hot air blower.

The third element, also in the shape of a tube and in two halves, is substantially the container of the second element and therefore the support of the system. The ringshaped space, between the two elements, is filled with highly insulating material, therefore assuring a good energy efficiency. A special mechanical system, fastened to the base, provides for supporting one of the two halves of the oven itself and for driving the other half in rotation of about 90°, performing the opening and closing of the oven itself. The operation of opening and closing the oven is necessary to facilitate the introduction of the yarn during starting the equipment and for the periodic operation (about every 50 hours) of removal of the resin residues deposited on the surfaces of the heating half-tubes ($7_1$, FIG. 12). A gearmotor, operated by automatic cycle or by the operator, performs said opening and closing movement.

Electric equipment, located in upper box already mentioned, provides the control and monitoring of the specific operations of said device; coordination of the automatic operations, therefore the interdependence of the various devices, is entrusted to the electronic control group of the unit.

The cooling device (8, FIG. 1) is a module located at the outlet of the polymerization ovens, through which the yarn passes to be cooled. Substantially, it is made up of two oxidized aluminum sections (8, FIG. 13), held in contact, by a spring system, in which a cooling liquid is made to flow. The device is fastened to a base of steel sheet similar to the other modules and is completed by the cowling and lateral fasteners.

Said base is provided with seats for mounting of two groups of yarn feed rolls completed with the relative transmission.

The unit in question ends with the winder and finished yarn reel support (9, FIG. 1, $9_1$, FIG. 1*a*) which is a device suitable for winding the finished yarn; said device has a unitized steel structure suitable for supporting three reels and is equipped with mechanisms that allow winding of the yarn on the reels. Three tangential rolls ($9_2$, $9_3$, $9_4$, FIG. 1*a*)—one of which is motorized by means of an electric motor with constant torque—provide for centering and control of the rotation of the working reel and of the waiting reels; when the first reel is filled, an electromechanical device cuts the yarn and moves the reels, putting the second one in the working position and excluding the first. Also when the second is filled, the same device will repeat the operation, putting the third reel in the working position and excluding the second. The completed reels can be removed, and without stopping the unit, be transported to storage.

Connected to the motorized roll, therefore perfectly synchronous, there is a mechanism that guides the yarn while it is being wound on the reel, determining the turns with a pass equal to the dimension of the yarn itself. An electric sensor provides for stopping of the unit when the yarn is finished and completely wound on the reel. The entire group, structurally independent and resting directly on the floor, is connected and aligned with the unit by means of suitable oscillating arms.

There is now described the preferred nonlimiting, nonbinding embodiment of the unit (FIG. 2) that peforms the roughing (11, FIG. 2) and finishing of the outside surface (13, FIG. 2) of the yarn (3, FIG. 2).

It comprises an automatic unit, with continuous linear transfer, suitable for rough and finish grinding of the outside surface of the capillary yarn. The raw yarn, unwinding from its reel (10, FIG. 2), feeds the unit. Said yarn, guided by special clamps ($11_1$, FIG. 14 and FIG. 15) which continuously adapt to the yarn, passes between three grinding wheels ($11_3$, FIG. 14 and FIG. 16) which, working longitudinally and orbiting around the yarn, perform the rough grinding. The roughed yarn continues through the first feed device (12, FIG. 2 and FIG. 17); guided by special clamps (as already for the roughing), it passes by two other tangential grinding wheels ($13_3$, FIG. 18 and FIG. 20) which, working radially and orbiting around the yarn, perform the finish grinding. The finished yarn continues through the second feed device (12, FIG. 2 and FIG. 17) and thus reaches the winder which, synchronous with the reel (14, FIG. 2), deposits it in orderly turns on the latter, then to be stored. The unit, built according to the design of modular elements, is comprised of the following:

a unitized steel sheet base suitable for supporting and connecting the various working units. In it is placed the mechanical transmission for driving the feed units (12, FIG. 2 and FIG. 17), and electric-electronic equipment for control and monitoring of all the operations.

a feed reel support, which is a unitized steel structure equipped with three tangential rolls—one of which is motorized—suitable for centering and driving of the rotation of the reel (10, FIG. 2) to perform the operation of unwinding of the raw yarn. The entire support, structurally independent and resting directly on the floor, is aligned and positioned, relative to the other working units, by suitable swinging arms which are connected to the base.

an independent roughing unit (11, FIG. 2) equipped with three arbors carrying grinding wheels perpendicular to the axis of the yarn—and of two yarn guide clamps ($11_1$, FIG. 14). The two clamps—incorporated in the supports of the unit—guide the yarn at the inlet and outlet; a double parallelogram ($11_2$, FIG. 14) makes possible their automatic and continuous adaptation to the yarn, therefore guaranteeing the perfect centering and constant tension of the yarn itself. The three arbors, mounted on swinging arms, rotate around the axis of the yarn, performing the orbital movement. The unit is moved by a variable speed gear, by which it is possible to select the most suitable working speed. The diameter of the yarn can be modified, even during working, by maneuvering a precision screw which moves the three grinding wheels ($11_3$, FIG. 14 and FIG. 16) closer or farther away. Said screw, being connected to the variable speed gear, makes it possible to keep the originally preselected working speed constant even after having modified the diameter of the yarn.

two feed devices (12, FIG. 2) that are independent mechanical groups equipped with two special opposing belts between which the yarn is taken and pulled at a preestablished speed.

A variable speed gear provides for driving two feed devices by means of a differential, guaranteeing the automatic and perfect compensation of the elongations that take place when going from the first to second device.

an independent finishing unit (13, FIG. 2), equipped with two arbors carrying grinding wheels parallel to the axis of the yarn, and of two yarn guide clamps ($13_1$, FIG. 18 and FIG. 19). The two clamps, incorporated in the supports of the unit, guide the yarn at the inlet and outlet; a double parallelogram ($13_2$, FIG. 18) makes possible their automatic, continuous adaptation to the yarn, therefore guaranteeing the perfect centering and constant tension of the yarn. The two arbors, mounted on swinging arms, rotate around the axis of the yarn, performing the orbital movement. The unit is moved by a variable speed gear, by which it is possible to select the most favorable working speed. The diameter of the yarn can be modified, even during working, by maneuvering a precision screw which moves the two grinding wheels ($13_3$, FIG. 18 and FIG. 20) closer or farther away. Said screw, being connected to the variable speed gear, makes it possible to keep the originally preselected working speed constant even after having modified the diameter of the yarn.

a reel (14, FIG. 2) for winding the finished yarn, which is a unitized steel structure, equipped with three tangential rolls—one of which is driven by an electric motor with constant torque—suitable for centering and for driving the reel in rotation. Winding of the yarn is performed by means of a yarn guide mechanism which determine the winding pass—equal to the dimension of the yarn itself—and is synchronized with the reel by taking its movement from a mechanical transmission connected to the motorized roll. The entire group, structurally independent and resting directly on the floor, is connected and aligned with the unit by means of suitable swinging arms.

transparent Plexiglas protections mounted on the base to convey the necessary powders to the work and to prevent acess by the operator to moving parts during the automatic operation of the unit.

There is now described the preferred nonlimiting, nonbinding embodiment of the unit (FIG. 3) which performs the grinding of both parts of the finished yarn sticks from the preworked yarn, the automatic transfer unit with intermittent rotary table (17, FIG. 3 and FIG. 22) suitable for production of points or yarn sticks—writing by capillary action—ground on both ($3_5$, FIG. 21 and FIG. 22) parts, from the round, ground yarn. The ground yarn is unwound from the feed reel. An alternating feed mechanism (16, FIG. 3), grasps the yarn and feeds the loader, which, by means of a thin diamond-coated disk ($22_1$, FIG. 22), rotating at high speed, provides the cutting of the yarn (3, FIG. 22) and loading of the relative piece on the rotary table. The piece of yarn just loaded—slightly longer than the yarn stick—is taken between two small springy rolls ($17_1$, FIG. 22) mounted on the rotary table. Said rolls center the stick and maintains it in constant contact with a stationary section ($17_3$, FIG. 21) mounted on the outside of the rotary table. During translation of the table the piece therefore is compelled to rotate on its axis. A mobile section ($17_2$, FIG. 21), side by side with the stationary one ($17_3$, FIG. 21), starts to move at the very moment in which rotary table stops, then to start a new cycle; this condition forces the piece to rotate continuously on its axis, even when the table is stopped, allowing relatively long work times. Four electric arbors (18, FIG. 3) equipped with suitably shaped grinding wheels ($18_1$, FIG. 21 and FIG. 22), two on one side and two on the other side of the table provide for rough and finish grinding of the stick. Said working system, based on the rotation of the piece around its axis, guarantees the perfect concentricity of the point intended to write relative to its outside diameter.

The unit built according to the concept of modular elements is comprised of the following:

a base (19, FIG. 3) of unitized steel sheet suitable for supporting and connecting the various working units.

a feed reel support that is a unitized steel structure equipped with three tangential rolls, one of which is motorized, suitable for centering and driving the reel in rotation (15, FIG. 3) to perform the operation of unwinding the ground yarn. The entire support, structurally independent and resting directly on the floor, is aligned and positioned by suitable swinging arms which are connected to the base.

a camshaft driven by a variable speed gear which provides, by cams, the synchronous driving of all the working movements and auxiliaries that move the units.

a rotary table carrying pieces (17, FIG. 3 and FIG. 22), operated by cams, which performs the operation of translating the piece to yarn coming from the loader, of carrying it during work, also supplying the working movement, and then to the finished work discharge station. The actual rotary table is an aluminum disk that mounts 24 pairs of small springy rolls ($17_1$, FIG. 22) having the task of centering the piece and enabling it to rotate, on the outside section ($17_3$, FIG. 21), rotating around its own longitudinal axis. Driving of the table takes place by means of a differential connected directly to the variable speed gear; the alternating movement is achieved by the action of a cam that, by moving the outside ring gear of the differential, determines the translation or stopping of the table. The system, not having empty return movements, allows the maximum use of time and the highest accelerations. The outside static section ($17_3$, FIG. 21), concentric with the rotary table, is fastened to the base and acts as a rotation track of the piece, while the table translates, and provides guiding of the dynamic section ($17_2$, FIG. 21). Said dynamic section determines the rotation of the piece when the table is stopped; its drive comes from a cam that guarantees the continuity of the movement of the piece inasmuch as it is perfectly synchronous with the translation.

four electric grinding arbors (18, FIG. 3) and the relative supports, equipped with suitable adjustments, in the radial direction and in the axial direction relative to the rotary table, suitable for performing the grinding the point of the stick in shape, by means of preshaped ceramic or polycrystalline diamond grinding wheels ($18_1$, FIG. 21 and FIG. 22).

an extractor and selector of the finished stick, which is a mechanical group suitable for conveying the good sticks into a suitable container outside the unit and for deflecting the rejected pieces into a special container. Extraction of the sticks, whether good or rejected, from the rotary table, takes place by means of a lever operated mechanically by the very translation of the table. Deflection of the rejected sticks takes place by means of a door that opens, on the normal path of the rejected sticks, by means of an electromagnet operated by an electromagnetic mechanism that provides the dimensional checking of the sticks when they are still held on the rotary table.

a complex mechanism that provides for performing the feeding, cutting the yarn and loading the cut yarn piece into the guide rolls on the rotary table. Said mechanism is fastened to the base and is suitably positioned relative the rotary table.

A mobile slide is equipped with a clamp which grasps the yarn and pulls it, making it follow a determined path at each alternation. A static yarn guide clamp locks the yarn after each alternation. Opening and closing of said clamps is mechanically operated by means of two cams synchronous with the rotary table.

When the feed travel of the preceding group is completed, a small electric arbor, equipped with a thin diamond-coated disk ($22_1$, FIG. 22), performs its working travel, cutting the yarn and therefore achieving a stick.

A mechanical loader is operated by two synchronous cams with the rotary table and obviously with the yarn feed. Substantially it consists of a support, fastened to the yarn feed, in which a slide travels which moves the piece up to inserting it onto the rotary table. A vertical slide, in a first time acts as a yarn guide and the assures that the piece, loaded onto the rotary table, remains in place.

There is now described the preferred nonlimiting, nonbinding embodiment of the following specific semiautomatic devices making possible the reliable control of the characteristics of the yarn, of the sticks and the determination of the dynamic corrections of the parameters defining the quality of the points writing by capillary action.

A semiautomatic device for the determination, or checking, of the degree of compactness of a piece of yarn: This is a precision mechanism that makes it possible to measure the elastic sag, in the longitudinal direction, and the buckling, in the crosswise direction, of a yarn sample loaded with a determined force applied at one specific, constant point at a determined distance from the reactions. The device has electronic sensors and an electronic circuit for digital display of the findings and for the corresponding storage of the values.

A semiautomatic device for comparison of the size of the outside diameter and of the roundness of a piece of ground yarn or of finished points: This is a precision mechanism for fastening and rotation of the sample to be measured on which is fastened an electronic comparator completed with digital display.

A semiautomatic device for measurement and comparison of the rate of absorption of the finished points or pieces of raw or ground yarn: Seven samples can be measured or compared at the same time. This is a tray with seven clamps, made of nonconductive material, placed on a vertical axis for fastening seven sample pieces and with seven electric contacts, connected to seven respective electronic chronometers, mounted on a upper support to touch the sample pieces that are underneath. The operation is based on measurement of the time taken by the conductive liquid to go, by capillary action, through the sample to be measured or checked and therefore to close the electric circuit with the respective upper contact.

A stereo enlarger to check the uniform distribution of the fibers and resin: Optical analysis is performed by means of said enlarger, the sample pieces having first been sectioned with a well sharpened blade.

An electronic precision balance for analysis of the characteristics of capillarity and capacity of the points or pieces of yarn: The operation takes place by weighing the dry samples and reweighing them after having the ink absorbed; the resulting weight difference is precisely the amount of ink that the sample can transport.

A device for inspection of the points and for the writing test: This is a complex independent automatic mechanism able to test seven samples of writing points at the same time. The samples are grasped by seven clamps mounted on a single support which simulates the writing movement; an underlying paper roll makes it possible to analyze the writing quality and resistance of the point.

An oven for analyses of the capillarity characteristics of the finished points or the pieces of yarn and tests of polymerization of the resin (raw material quality control).

An electronic balance to determine the proportioning of the components of the resin for quality tests of the raw materials.

A series of test tubes for quality control of the raw materials.

I claim:

1. In a method for the production of a yarn comprised of capillary fibers which yarn is suitable for use in absorbent writing elements, said method comprising the steps of (a) forming a continuous yarn from textile fibers;
(b) setting the moisture content of said yarn at a predetermined level;
(c) impregnating said yarn with a polymerizable resin;
(d) polymerizing said resin by application of heat to said impregnated yarn; and
(e) cooling said yarn to yield a product yarn; the improvement comprising the additional steps of
(f) sensing the elastic sag in the longitudinal direction of the yarn and sensing the buckling in the transverse direction of the product yarn;
(g) sensing the diameter and degree of roundness of said product yarn;
(h) determining the rate of moisture absorption of said product yarn;
(i) determining the degree of uniform distribution of said fibers within said product yarn;
(j) determining the absorption capacity of said yarn product; and employing said sensed and determined values to control the conduct of steps (a)–(e) of said method.

2. The method of claim 1 wherein said continuous yarn is formed by combining multiple staple fibers together.

3. The method of claim 1 wherein a twist is formed in said continuous yarn subsequent to formation of same.

4. The method of claim 1 further comprising the step of modifying the cross-sectional configuration of said product yarn during formation of same.

5. The method of claim 4 wherein cross-sectional configuration is modified during formation of said product yarn by passing said yarn between opposing shaped roller surfaces in order to advance said yarn from one step to another, said yarn being compressed between said opposing shaped roller surfaces and the cross-sectional configuration of said yarn being modified as a result of said compression.

6. The method of claim 5 wherein said yarn is passed between two pairs of opposing rollers having shaped surfaces, each pair of rollers being oriented along an axis which is perpendicular to the axis of the other pair of rollers.

7. In an apparatus for the production of a yarn comprised of capillary fibers which yarn is suitable for use in absorbent writing elements, said apparatus comprising (a) means to form a continuous yarn from textile fibers;
(b) means to set the moisture content of said yarn at a predetermined level;
(c) means to impregnate said yarn with a polymerizable resin;
(d) means to polymerize said resin by application of heat to said impregnated yarn;
(e) means to cool said yarn to yield a product yarn; and
(f) means to convey said yarn between said respective means; the improvement wherein said apparatus additionally comprises
(g) sensing means to sense the elastic sag in the longitudinal direction of the yarn and means to sense the buckling in the transverse direction of the product yarn;
(h) means to sense the diameter and degree of roundness of said product yarn;
(i) means to determine the rate of moisture absorption of said product yarn;
(j) means to determine the degree of uniform distribution of said fibers within said product yarn;
(k) means to determine the absorption capacity of said yarn product; and means to employ said sensed and determined values to control the operation of means (a)–(f) of said apparatus.

8. The apparatus of claim 7 further comprising means to modify the cross-sectional configuration of said yarn as it is conveyed between said respective means.

9. The apparatus of claim 8 wherein said means to modify said cross-sectional configuration comprises roller means, said roller means including opposing shaped surfaces between which said yarn is conveyed.

10. The apparatus of claim 9 wherein said roller means includes two pairs of opposing rollers, each pair of rollers being oriented along an axis which is perpendicular to the axis of the other pair of rollers.

11. The apparatus of claim 7 wherein said means to set the moisture content of said yarn at a predetermined level includes means to contact said yarn with moist air.

12. The apparatus of claim 7 wherein said means to polymerize said resin by application of heat to said impregnated yarn comprises oven means through which said yarn passes.

13. The apparatus of claim 7 further including grinding means to finish the surface of said product yarn.

14. The apparatus of claim 7 further including means to cut said product yarn into predetermined lengths.

* * * * *